US008808155B2

(12) United States Patent
Zonneveld et al.

(10) Patent No.: US 8,808,155 B2
(45) Date of Patent: Aug. 19, 2014

(54) CENTRIFUGE BOWL WITH LINER MATERIAL MOLDED ON A FRAME

(75) Inventors: Edwin John William Zonneveld, Fort Langley (CA); John Douglas Corsan, Abbotsford (CA); Michael McLeavy, Delta (CA); Michael John Fullam, White Rock (CA)

(73) Assignee: FLSmidth Inc., Bethlehem, PA (US)

( * ) Notice: Subject to any disclaimer, the term of this patent is extended or adjusted under 35 U.S.C. 154(b) by 1011 days.

(21) Appl. No.: 12/835,140

(22) Filed: Jul. 13, 2010

(65) Prior Publication Data

US 2011/0028296 A1 Feb. 3, 2011

Related U.S. Application Data

(60) Provisional application No. 61/229,300, filed on Jul. 29, 2009.

(51) Int. Cl.
*B04B 11/04* (2006.01)

(52) U.S. Cl.
USPC ..... 494/29; 494/67; 494/80

(58) Field of Classification Search
USPC ..... 494/23–30, 37, 43, 45, 46, 60, 62, 80, 494/84, 67; 210/360.1, 380.1; 209/270
See application file for complete search history.

(56) References Cited

U.S. PATENT DOCUMENTS 556,567 A * 3/1896 Waring ..... 494/80
566,807 A * 9/1896 Simonds ..... 494/68
632,616 A * 9/1899 Alfven ..... 494/80
981,679 A * 1/1911 Peck ..... 494/11
1,011,078 A * 12/1911 Peck ..... 494/11
1,012,097 A * 12/1911 Peck ..... 494/1
1,097,561 A * 5/1914 Resines ..... 494/37
1,239,734 A * 9/1917 Sloan et al. ..... 494/45
1,283,846 A * 11/1918 Mark et al. ..... 494/60
1,473,421 A * 11/1923 Eccleston ..... 494/29
1,542,747 A * 6/1925 Verney ..... 494/58
1,557,672 A * 10/1925 Doerner ..... 209/199
1,594,501 A * 8/1926 Eccleston ..... 494/29
1,599,502 A * 9/1926 Thomassen ..... 494/43
1,684,870 A * 9/1928 Lewis ..... 209/199

(Continued)

FOREIGN PATENT DOCUMENTS

AU 22055/35 4/1935
CA 2271958 6/1998

(Continued)

*Primary Examiner* — Charles Cooley
(74) *Attorney, Agent, or Firm* — Adrian D. Battison; Ade & Company Inc.

(57) ABSTRACT

A centrifuge concentrator bowl has feed deposited onto a base of the bowl and includes a plurality of recesses at axially spaced positions along a peripheral wall of the bowl. The peripheral wall is formed of a rigid metal skeleton frame of rings and upstanding support members on which is molded a urethane liner material to form an integral structure with the rings located at ribs between the recesses. A fluidization water injection system includes an outer container on the bowl, which also acts as a clamping assembly and a plurality of liquid entry openings through the peripheral wall at the base of the recesses allowing flexing of the peripheral wall in response to changes in pressure in the fluidizing liquid. The bowl is formed of separate sections defined by a bottom concave base section and the cast skeleton wall all clamped together to allow replacement of the separate parts.

20 Claims, 9 Drawing Sheets

(56) References Cited

U.S. PATENT DOCUMENTS

| | | | | | |
|---|---|---|---|---|---|
| 1,718,547 | A | * | 6/1929 | Eccleston | 494/29 |
| 1,733,266 | A | * | 10/1929 | Jones | 210/374 |
| 1,750,860 | A | * | 3/1930 | Rawlings | 494/2 |
| 1,828,096 | A | * | 10/1931 | Bryson | 494/37 |
| 1,853,249 | A | * | 4/1932 | Ainlay | 494/43 |
| 1,935,547 | A | * | 11/1933 | Dryhurst | 494/67 |
| 1,981,924 | A | * | 11/1934 | Reese et al. | 494/56 |
| 2,022,926 | A | * | 12/1935 | Schlank | 494/32 |
| 2,112,099 | A | * | 3/1938 | Ballou et al. | 494/67 |
| 2,132,195 | A | * | 10/1938 | Stirn | 494/80 |
| 2,133,271 | A | * | 10/1938 | Brintnall | 209/14 |
| 2,140,388 | A | * | 12/1938 | Lucas | 494/80 |
| 2,146,716 | A | * | 2/1939 | Bennett | 209/199 |
| 2,147,102 | A | * | 2/1939 | Lonergan | 494/80 |
| 2,161,476 | A | * | 6/1939 | Leja | 494/45 |
| 2,161,477 | A | * | 6/1939 | Leja | 209/422 |
| 2,179,807 | A | * | 11/1939 | Asmussen | 494/27 |
| 2,719,807 | A | | 11/1939 | Asmussen | |
| 2,199,847 | A | * | 5/1940 | Bryson | 494/44 |
| 2,272,675 | A | * | 2/1942 | Knudsen | 494/45 |
| 2,415,210 | A | * | 2/1947 | Hoefling | 494/62 |
| 2,472,475 | A | * | 6/1949 | Hamilton | 209/199 |
| 2,563,249 | A | * | 8/1951 | Koziol | 209/270 |
| 2,590,735 | A | * | 3/1952 | Svensjo | 494/38 |
| 2,688,437 | A | * | 9/1954 | Monnet | 494/26 |
| 2,782,925 | A | * | 2/1957 | Morton | 494/27 |
| 3,425,561 | A | * | 2/1969 | Steele et al. | 210/380.1 |
| 3,595,470 | A | * | 7/1971 | Shapiro | 494/5 |
| 3,730,423 | A | * | 5/1973 | Coulson | 494/37 |
| 3,823,869 | A | * | 7/1974 | Loison | 494/56 |
| 3,963,175 | A | * | 6/1976 | Daubman et al. | 494/74 |
| 4,072,266 | A | * | 2/1978 | Dietzel | 494/36 |
| 4,115,278 | A | * | 9/1978 | Fritsch | 210/488 |
| 4,286,748 | A | * | 9/1981 | Bailey | 494/29 |
| 4,361,480 | A | * | 11/1982 | Corbus et al. | 209/453 |
| 4,608,040 | A | * | 8/1986 | Knelson | 494/27 |
| 4,776,833 | A | * | 10/1988 | Knelson | 494/27 |
| 4,824,431 | A | * | 4/1989 | McAlister | 494/43 |
| 4,846,781 | A | * | 7/1989 | Knelson | 494/27 |
| 4,891,041 | A | * | 1/1990 | Hohmann et al. | 494/62 |
| 4,932,933 | A | * | 6/1990 | Becker et al. | 494/62 |
| 4,981,219 | A | * | 1/1991 | Burnell et al. | 209/453 |
| 4,983,156 | A | * | 1/1991 | Knelson | 494/28 |
| 5,011,023 | A | * | 4/1991 | Arai | 209/400 |
| 5,087,127 | A | * | 2/1992 | Knelson | 494/37 |
| 5,222,933 | A | * | 6/1993 | Knelson et al. | 494/29 |
| 5,230,797 | A | * | 7/1993 | Knelson | 210/380.1 |
| 5,338,284 | A | * | 8/1994 | Knelson | 494/28 |
| 5,354,256 | A | * | 10/1994 | Knelson | 494/80 |
| 5,364,335 | A | * | 11/1994 | Franzen et al. | 494/15 |
| 5,368,541 | A | * | 11/1994 | Knelson | 494/37 |
| 5,372,571 | A | * | 12/1994 | Knelson et al. | 494/29 |
| 5,421,806 | A | * | 6/1995 | Knelson et al. | 494/37 |
| 5,462,513 | A | * | 10/1995 | McAlister | 494/56 |
| 5,586,965 | A | * | 12/1996 | Knelson | 494/29 |
| 5,591,340 | A | * | 1/1997 | Meikrantz et al. | 210/512.3 |
| 5,601,523 | A | * | 2/1997 | Knelson | 494/29 |
| 5,601,524 | A | * | 2/1997 | Knelson | 494/29 |
| 5,713,826 | A | * | 2/1998 | West | 494/45 |
| 5,728,039 | A | * | 3/1998 | Knelson | 494/29 |
| 5,733,238 | A | * | 3/1998 | Carr | 494/58 |
| 5,743,840 | A | * | 4/1998 | Carr | 494/13 |
| 5,895,345 | A | * | 4/1999 | Knelson | 494/29 |
| 6,095,965 | A | * | 8/2000 | Eiderman et al. | 494/80 |
| 6,149,572 | A | * | 11/2000 | Knelson | 494/37 |
| 6,244,446 | B1 | * | 6/2001 | Schmittel | 209/157 |
| 6,706,180 | B2 | * | 3/2004 | Kirker et al. | 210/232 |
| 6,740,027 | B1 | * | 5/2004 | Benson | 494/29 |
| 6,796,934 | B1 | * | 9/2004 | McAlister et al. | 494/56 |
| 6,808,481 | B1 | * | 10/2004 | Cornay | 494/33 |
| 6,932,913 | B2 | * | 8/2005 | Kirker et al. | 210/781 |
| 6,939,286 | B1 | * | 9/2005 | Hurdlow | 494/56 |
| 6,962,560 | B2 | * | 11/2005 | Grewal | 494/29 |
| 6,986,732 | B2 | * | 1/2006 | Zonneveld et al. | 494/29 |
| 6,997,859 | B2 | * | 2/2006 | Peacocke et al. | 494/29 |
| 7,144,360 | B2 | * | 12/2006 | Zonneveld et al. | 494/29 |
| 7,500,943 | B1 | * | 3/2009 | Peacocke et al. | 494/29 |
| 7,503,888 | B1 | * | 3/2009 | Peacocke et al. | 494/29 |
| 7,585,269 | B2 | * | 9/2009 | McAlister | 494/26 |
| 8,020,498 | B2 | * | 9/2011 | Cavaliere et al. | 110/216 |
| 8,096,933 | B2 | * | 1/2012 | Song | 494/34 |
| 8,343,025 | B2 | * | 1/2013 | McAlister et al. | 494/29 |
| 2004/0121892 | A1 | * | 6/2004 | Zonneveld et al. | 494/67 |
| 2004/0132601 | A1 | * | 7/2004 | Peacocke et al. | 494/29 |
| 2005/0026766 | A1 | * | 2/2005 | Grewal | 494/29 |
| 2006/0135338 | A1 | * | 6/2006 | Zonneveld et al. | 494/29 |
| 2008/0272067 | A1 | * | 11/2008 | Cavaliere et al. | 210/788 |
| 2008/0280746 | A1 | * | 11/2008 | McAlister | 494/8 |
| 2010/0240513 | A1 | * | 9/2010 | McAlister et al. | 494/37 |
| 2011/0028296 | A1 | * | 2/2011 | Zonneveld et al. | 494/29 |

FOREIGN PATENT DOCUMENTS

| | | | | | |
|---|---|---|---|---|---|
| EP | 275159 | A2 | * | 7/1988 | B04B 1/02 |
| WO | WO 9313864 | A1 | * | 7/1993 | B04B 1/14 |
| WO | 9637307 | A1 | | 11/1996 | |
| WO | WO 9637307 | A1 | * | 11/1996 | B04B 1/00 |
| WO | WO 2006111008 | A1 | * | 10/2006 | B01D 21/26 |
| WO | WO 2007143817 | A1 | * | 12/2007 | |
| WO | WO 2008049212 | A1 | * | 5/2008 | B04B 1/00 |

* cited by examiner

FIG.3 DETAIL A

DETAIL D

CENTRIFUGE BOWL WITH LINER MATERIAL MOLDED ON A FRAME

This application claims the benefit under 35 U.S.C. 119 of Provisional Application 61/229,300 filed Jul. 29, 2009.

This invention relates to a centrifugal separator of the type having a plurality of axially spaced annular recesses on a peripheral wall of a rotatable bowl.

BACKGROUND OF THE INVENTION

In U.S. Pat. Nos. 4,608,040; 4,776,833; 5,222,933; 5,421,806; 5,230,797 and 5,338,284 of Benjamin Knelson and now assigned to the present Assignee discloses a number of different arrangements of centrifugal separator of the type including a rotatable bowl having a peripheral wall of generally frusto-conical shape on which is provided a plurality of axially spaced, annular recesses. The particulate material containing fractions of different specific gravity to be separated is fed in slurry form through a feed duct to a position at or adjacent a base of the bowl so that the feed materials pass over the peripheral wall with heavier particulate materials collecting in the annular recesses while lighter particulate materials escape from the bowl through the open mouth. In the above patents, all of the annular recesses are fluidized by the injection of fluidizing water through holes in the peripheral wall at the respective recesses thus acting to fluidize the collecting material within the recesses.

A further arrangement is disclosed in U.S. Pat. No. 5,586,965, issued Dec. 24, 1996 of the above inventor in which the number of recesses is reduced and a frusto-conical lead-in section of the bowl is provided which is free from fluidized recesses so that the feed material is deposited onto the lead-in section and flows over that lead-in section prior to reaching the first annular recess.

In all cases the fluidized recesses are formed by providing drilled holes through the base of the recess in the manner disclosed in U.S. Pat. Nos. 4,608,040 and 5,230,797 above. This provides requirements on the construction and location of the holes which can lead to blockage and can limit the ability to tailor the arrangements to the best processing parameters.

In Australian Published Application 22,055/35 published 2 Apr. 1935 by Macnicol is disclosed a centrifuge bowl where the recesses on the peripheral wall are fluidized by injecting water through the wall and where the holes through the wall are covered by a band of screen material applied on the inside surface of the wall. The purpose of this screen is not explained. This device has not achieved commercial success and the disclosure has been long abandoned as a workable arrangement.

In Canadian Patent Application 2,085,064 of the above inventor published 12 Jun. 1993 is disclosed an arrangement using the machine having conventional V-shaped recesses of the type disclosed in the above patents in which an annular insert of a screen mesh material is placed in each recess at a position spaced from the base of the recess and spaced from the mouth of the recess with the intention of forming a recess which is shallower than the conventional recess. The shallow recesses are intended to form a concentrate which is richer than that of a conventional concentrator since less material is collected in each recess and it is stated that the machine is intended to be used as a "final separator" in a process of repeated concentration. Thus the inventor intended that in a line of conventional separators, the last would be modified from the conventional by the addition the mesh material inserts to form the special shallow recesses for the last separator only.

In Canadian Application 2,443,239 filed Oct. 15, 2003 by the present assignees and published on Dec. 28, 2003 which corresponds to U.S. Pat. No. 6,997,859 issued Feb. 14, 2006 is disclosed an arrangement of the above type in which an insert ring is provided which is inserted into at least some of the recesses to define a base of the recess with the ring being perforated and spaced from the bottom of the recess. The ring is thus a replaceable item within the bowl.

In Canadian Application 2,529,977 filed Dec. 6, 2005 by the present assignees and published on Jun. 22, 2006 which corresponds to U.S. Pat. No. 7,144,360 issued Dec. 5, 2006 is disclosed an arrangement of the above type in which some of the recesses are at least partly defined by a removable insert member arranged to be attached to a suitable mounting on the wall of the bowl. Each insert member includes a face portion defining a surface facing toward the axis of the bowl for engaging the slurry and preventing wear. The face portion may include a side portion on one side or both sides located radially inwardly of a rib on a respective side of the recess and at least partly covering the rib so as to prevent the slurry from contacting the rib and causing wear to the rib.

In U.S. Pat. No. 4,983,156 (Knelson) issued Jan. 8, 1991 is disclosed a centrifugal separator for extracting heavy metals from a slurry which comprises a centrifuge bowl having an inwardly facing surface over which the slurry runs. A dam at a discharge end of the surface forms a shallow layer of particles which separate preferentially the heavy metals. The surface includes a portion formed by a plurality of annular membrane portions spaced axially and separated by radial rings extending from the surface to a supporting metal bowl. The membranes are deflated or retracted to gradually form annular cups for receiving the separated metals. The membranes are then inflated to discharge the collected materials while the feed is temporarily halted and the bowl continues to rotate. A similar arrangement is shown in U.S. Pat. No. 2,179,807 (Asmussen) issued Nov. 14, 1939.

SUMMARY OF THE INVENTION

It is one object of the present invention to provide an improved bowl of centrifugal separator for separating intermixed particulate materials of different specific gravity in a slurry where the apparatus includes a feed duct for feeding the slurry into the bowl during rotation of the bowl so that during rotation of the bowl the intermixed particulate materials flow over a peripheral wall of the bowl for collection of heavier particulate materials on the peripheral wall and for discharge of the lighter particulate materials in the slurry from the open mouth.

According to a first aspect of the invention, the bowl comprises:

a peripheral wall surrounding an axis passing through the base with the wall generally upstanding from the base to an open mouth;

wherein the peripheral wall includes a supporting frame formed of a rigid material and a liner material carried on the supporting frame;

the supporting frame being defined by a plurality of ring members which are axially spaced each from the next to define a space between each ring member and the next;

the supporting frame including a plurality of generally axially extending support members;

wherein the axially spaced ring members are connected each to the next by the generally axially extending support members which are angularly spaced to define a space between each support member and the next;

the liner material being carried on the supporting frame to define an inner surface of the peripheral wall and to fill the spaces between the ring members and between the support members.

The bowl may also include other components for example a base section which is typically dished or concave. However the key component of the bowl is the peripheral wall section. This can be supplied as a separate section as a spare part for a bowl of the type including a separate base section or as a complete bowl and it is the intention to provide protection for both complete bowls and for the peripheral wall section of a separate component type of bowl.

The bowl also typically includes an outer support section and again this may be included with the bowl or may form a separate section from the key peripheral wall section.

Preferably the inner surface of the peripheral wall includes a plurality of annular recesses on the peripheral wall at axially spaced positions over which the materials pass when fed from the supply duct. However the bowl may be of a type having only one recess or a limited number of recesses or may have no recesses and may separate the material using other bowl shapes.

Preferably each recess is defined by an upper recess side wall on the upper side and a lower recess side wall on a lower side with each of the side walls extending generally outwardly from the axis from an open mouth of the recess toward a base of the recess, the upper side wall of each recess being connected to the lower side wall of a next adjacent recess to form a rib between the recesses such that the bowl includes a plurality of recesses and a plurality of ribs arranged alternately along the peripheral wall.

Preferably there is provided a fluidizing liquid injection system for fluidizing the materials on the peripheral wall including a liquid supply outside the wall and a plurality of liquid entry openings at angularly spaced positions around the wall. However the bowl may be of the imperforate type to reduce water usage.

Preferably the liquid entry openings are located in the liner material at positions thereon separated from the supporting frame.

Preferably, the positioning of the openings at the locations spaced from the frame structure allows the liner material to flex in response to changes in pressure in the fluidizing liquid. This flexing action can be used to cause the liner material to shed or dislodge collected scale or other materials.

Preferably the flexible liner material is urethane, although other wear resistant materials can be used. In one example ceramic material can be molded onto the frame and may not flex under pressure changes.

Preferably the fluidizing liquid injection system includes a chamber outward of the peripheral wall in which the fluidizing liquid is located such that the fluidizing liquid contacts an outer surface of the flexible liner material to cause the flexible liner material to flex under pressure changes.

Preferably the ring members form annular disks each lying in a radial plane of the axis of the bowl and each arranged in a respective one of the ribs. The ring members are preferably continuous around the bowl but can be formed in separate sections.

Preferably the ribs and the recesses are molded from the flexible liner material onto the supporting frame to form an integral structure.

Preferably the peripheral wall is formed as a single member extending from the base section to a top ring.

Alternatively the peripheral wall can be formed as a plurality of separable members stacked one above the next.

Preferably the base is defined by a base section which is separable the peripheral wall and there are provided components to hold the base section and peripheral wall in a stacked assembled position. These components can comprise an exterior clamping system defined by an outer bowl but more preferably the base section is bolted to the peripheral wall at cooperating flanges between the base and peripheral wall and the top of the peripheral wall is bolted to the outer bowl. The outer bowl typically forms the containment for the fluidizing liquid.

Preferably the base section includes a plurality of angularly spaced locating wings for engaging the exterior drum to locate the base section in the drum.

Preferably the base section includes a central pedestal member standing upwardly from a bottom of the base section onto the top of which is mounted a deflector pad and preferably a single central fastener is used to attach the deflector pad to the pedestal member.

Preferably the base section comprises a generally concave portion with a generally upstanding surrounding wall and wherein the peripheral wall portion has a bottom edge which butts the top edge of the surrounding wall.

Preferably the peripheral wall includes a top clamping ring for engaging a top of the clamping assembly which is preferably integral with the peripheral wall or it may form a separate item.

According to a second aspect of the invention, the bowl comprises:

a bowl wall portion;

a fluidizing liquid injection system for fluidizing the materials at the bowl wall portion including a liquid supply and a plurality of liquid entry openings extending from the supply through the bowl wall portion;

the bowl wall portion being formed of a flexible liner material which is free to flex at the entry openings in response to changes in pressure in the fluidizing liquid.

According to a third aspect of the invention, the bowl comprises:

a base and a peripheral wall surrounding an axis passing through the base with the wall generally upstanding from the base to an open mouth;

and a plurality of annular recesses on the peripheral wall at axially spaced positions over which the materials pass when fed from the supply duct;

each recess being defined by an upper recess side wall on the upper side and a lower recess side wall on a lower side with each of the side walls extending generally outwardly from the axis from an open mouth of the recess toward a base of the recess;

the upper side wall of each recess being connected to the lower side wall of a next adjacent recess to form a rib between the recesses such that the bowl includes a plurality of recesses and a plurality of ribs arranged alternately along the peripheral wall;

at least one of the recesses having a fluidizing liquid injection system for fluidizing the materials in the respective recess including a liquid supply and a plurality of liquid entry openings at angularly spaced positions around the recess with each liquid entry opening extending from the supply into the recess at or closely adjacent the base of the recess;

the liquid entry openings being located in a flexible portion of the peripheral wall which is free to flex in response to changes in pressure in the fluidizing liquid.

According to a fourth aspect of the invention, the bowl comprises:

a base section;

a peripheral wall surrounding an axis passing through the base section with the wall generally upstanding from the base section to an open mouth;

the base section and peripheral wall being separable and being connected to hold the base section and peripheral wall in a stacked assembled position.

BRIEF DESCRIPTION OF THE DRAWINGS

One embodiment of the invention will now be described in conjunction with the accompanying drawings in which.

DETAILED DESCRIPTION

Figure 1:
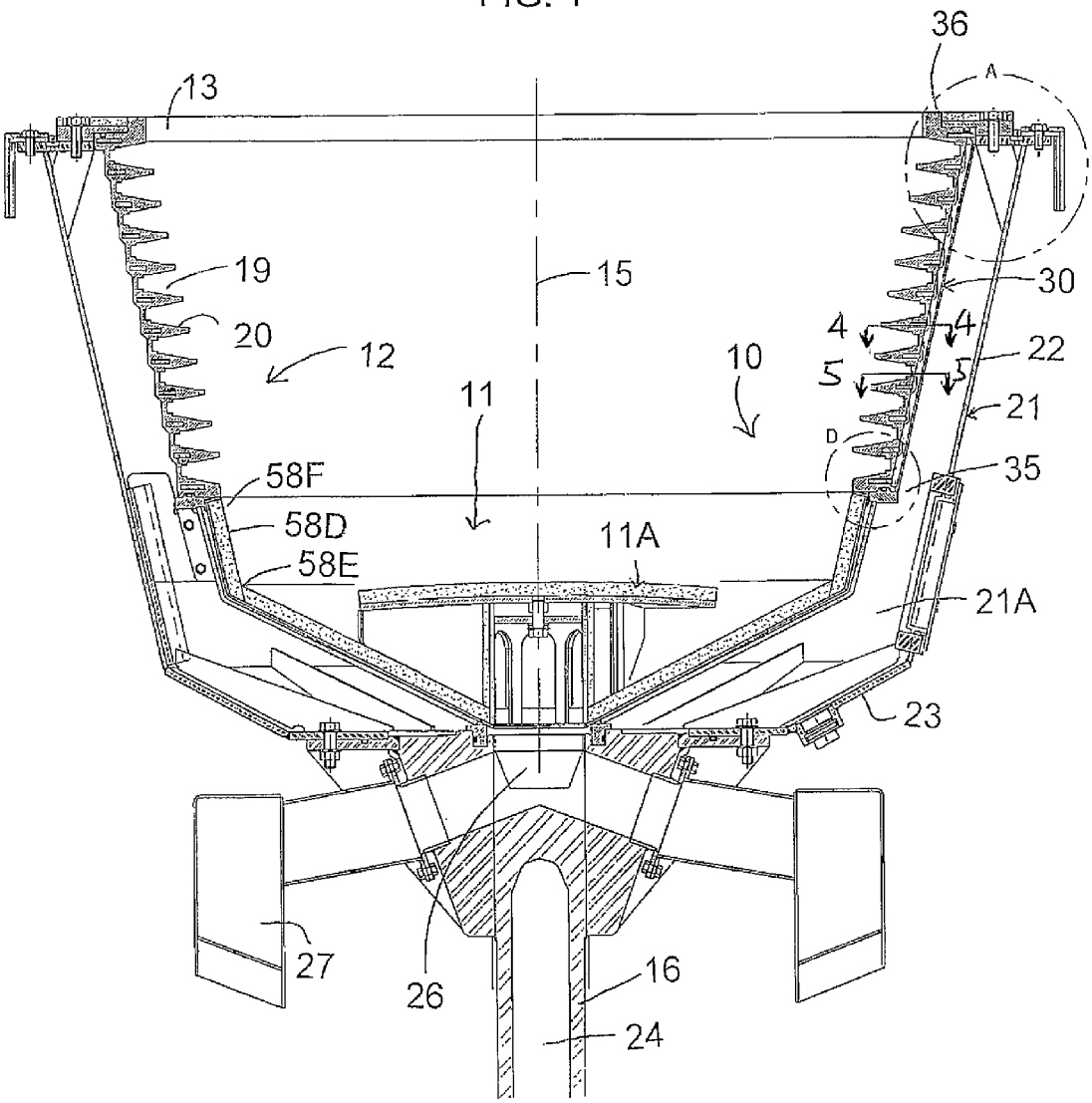
FIG. 1 is vertical cross sectional view through a bowl according to the present invention of a centrifugal separator.

The general arrangement of the centrifugal separator is shown for example in FIG. 1 of the above U.S. Pat. No. 5,222,933 and therefore will described only briefly in regard to the points of importance. The disclosures of the above patents of the present assignee, which are incorporated herein by reference, may be referred to for further details which may be necessary for a full understanding.

The apparatus therefore comprising a bawl generally indicated at 10 having a base generally indicated at 11 and a peripheral wall 12 standing upwardly from the base to an open mouth 13. The bowl can rotate around an axis 15 on a support shaft 16.

A feed duct carries feed materials in the form of a mixture of heavier and lighter particulate materials in a water slurry through the open mouth 13 to a position adjacent to the base 11 so the feed materials can be deposited onto a horizontal deflector pad 11A at the base 11 and can move therefrom onto the peripheral wall 12 for separation of the heavier materials into a plurality of recesses 19 on the peripheral wall while the lighter materials in the slurry pass over the peripheral wall to the open mouth for discharge. The recesses are annular and are axially spaced. The peripheral wall is frusto-conical so that the diameter of the recesses increases from a first recess at the base to a last recess at the open mouth. Material exiting from the open mouth is collected by a launder (not shown) for discharge.

Around the bowl 10 is provided a jacket 21 having a peripheral wall 22 and a base 23 both of which are connected to the respective elements of the bowl so as to form a compartment 21A fed with fluidizing water from a central duct 24 of the shaft 16 through connecting ducts (not shown). The compartment 21A therefore receives fluidizing water under pressure which is communicated through openings in the peripheral wall 12 into the recesses for adding fluidizing water into the material collecting in the recesses.

The separation and collection process is a batch process so that the heavier material is collected in the recesses for subsequent wash down and collection. The collected materials when washed down to the base pass through a discharge opening 26 into a second collection system 27 for collecting the concentrate.

The feed duct comprises a cylindrical tube carried on a cover of the launder. Thus the tube forming the feed duct is in fixed position and remains stationary as the bowl rotates around the axis 15.

The recesses 19 are generally of the type previously described in earlier patents and include side walls which converge generally outwardly from the axis toward a base of the recess which is narrower than an open mouth of the recess. The base has a width sufficient so that the holes pass through the peripheral wall of the bowl into the base so that the fluidizing water in the compartment 21A can pass through the holes to fluidize the materials within the recess 19.

As described in detail in the above U.S. Pat. No. 4,776,833, the recesses are formed by molding a resilient liner material. Thus the bowl is structurally formed from metal. The liner material is generally a resilient plastics material such as urethane which is resistant to wear since it can flex under the impact from the materials.

In prior arrangements the bowl is formed from an outer metal drum onto the inside surface on which is applied a molded layer of a resilient liner material such as urethane.

Figure 3:
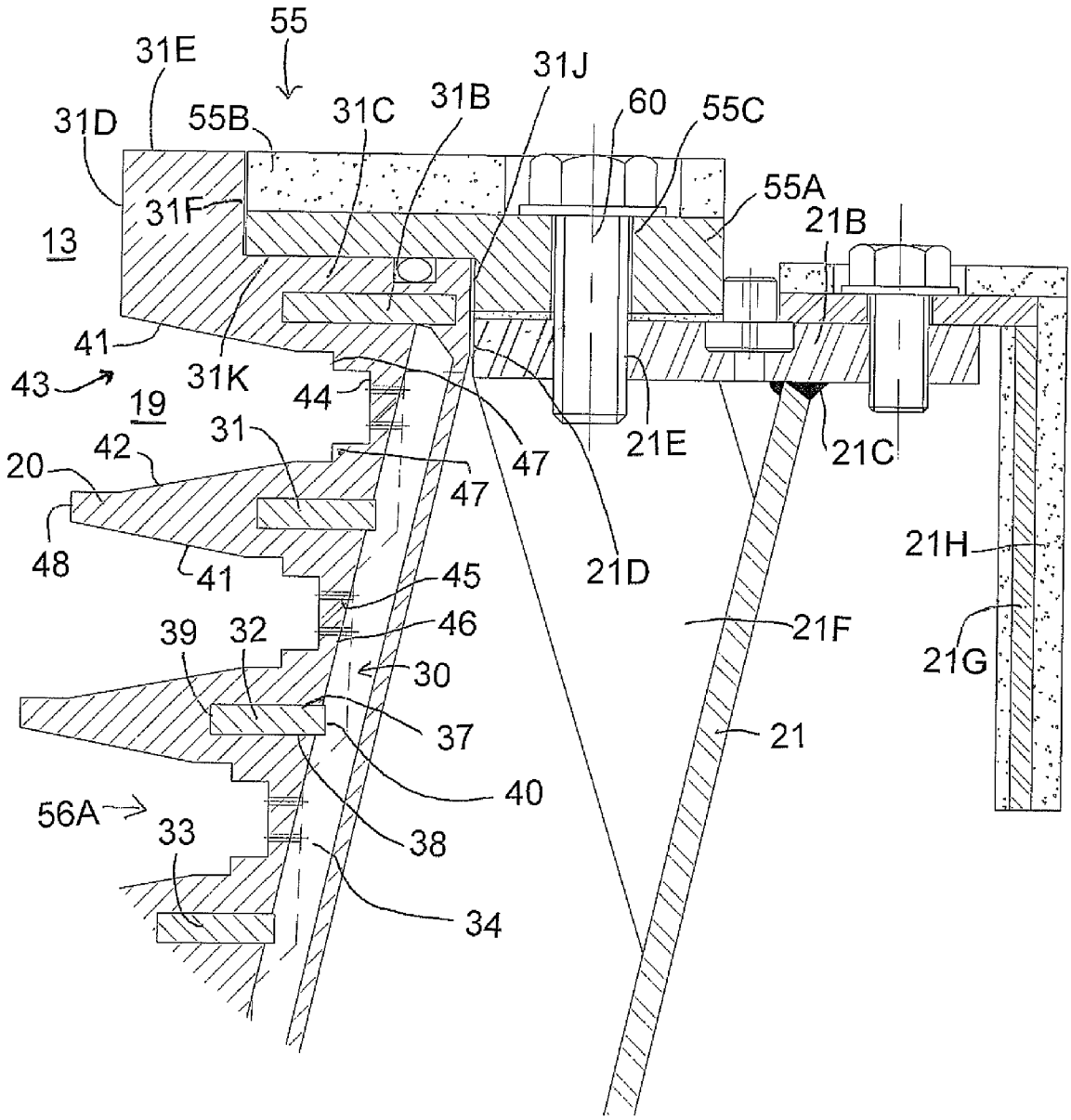
FIG. 3 is a cross sectional view on an enlarged scale of the detail A of the bowl of FIG. 1.
Figure 4:
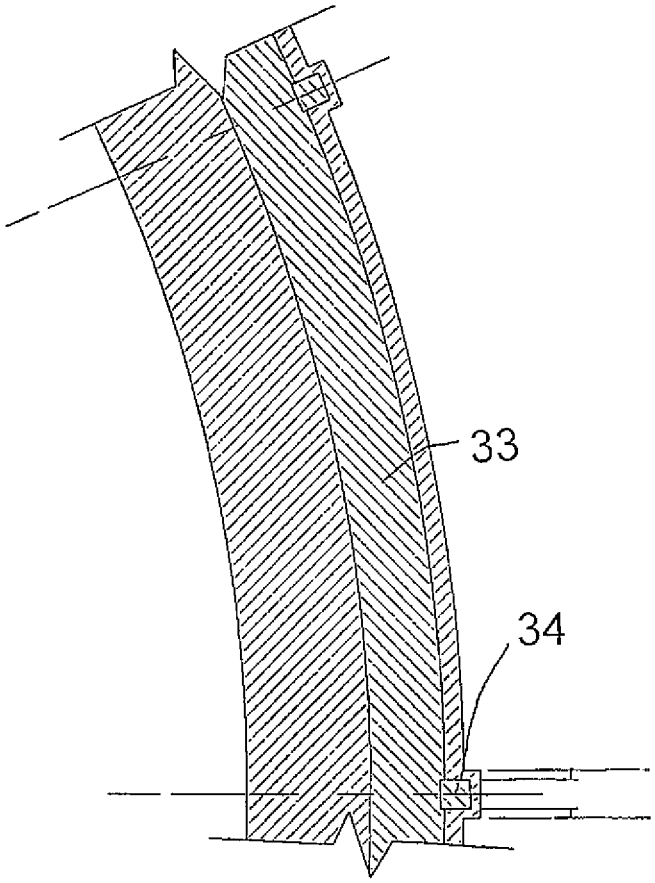
FIG. 4 is a cross sectional view on an enlarged scale taken along the lines 4-4 of the bowl of FIG. 1.

In the present arrangement as shown in the cross sections of FIGS. 1, 3 and 4, instead of using a metal drum, the bowl is formed from a skeleton frame generally indicated at 30 which includes a series of rings 31, 32, 33 etc. together with supporting upstanding bands or bars 34. The rings are continuous and annular and form disks lying in a radial plane of the axis, and each ring is separate from the next, apart from the connecting and supporting bands, with the rings spaced axially along the length of the bowl from a lower end 35 of the peripheral wall to an upper end 36 of the peripheral wall at the open mouth 13. The rings each lie in a respective horizontal plane with a horizontal top surface 37, a horizontal bottom surface 38, an inner surface 39 and an outer surface 40.

As in the conventional system, the bowl is generally frusto-conical so that the upper end 36 is spaced radially outwardly relative to the axis 15 as compared with the lower end 35. Each ring is therefore of a larger diameter than its next adjacent lower ring so that the outer edges 40 are located on a frusto-conical surface surrounding the axis 15.

Around the axis 15 at angularly spaced positions is provided the plurality of generally upstanding bands or bars 34 which extend from the lower end 35 to the upper end 36. Thus each bar 34 lies in the frusto conical surface and extends from the bottom ring 31A shown in FIG. 6 to the top ring 31B shown in FIG. 3.

The bars 34 are spaced angularly around the axis and each is separate from the next. Thus the whole structure is formed by simply the rings and the bars with open areas in between these structures which is unsupported by any metal component.

The liner material forming the surface of the bowl is molded onto the skeleton structure 30 so as to form the conventional recesses 19 which are separated for each from the next by a respective ring or rib 20. The recesses are annular and are continuous around the angular extent of the bowl so that fluid is free to rotate around the bowl in the recess. The ribs are similarly continuous around the bowl so as to separate each recess from the next along the full length of the respective recesses.

Each recess is formed by side walls 41 and 42 which converge from an open mouth 43 at the top of the ribs inwardly to a base 44 of the recess adjacent the frusto-conical plane defined by the bars 34. Thus the recesses are generally V shaped converging to the base as the base has a height to allow penetration through the base of two rows of fluid injection holes 45 and 46. The side walls 41 and 42 have a step or shoulder 47 at a position closely adjacent the base 44 where the width of the recess is increased relative to the base and from which the recess diverges outwardly to the mouth 43. This shoulder can be used to mount the base strip which is the subject of Canadian Application 2,443,239 which corresponds to U.S. Pat. No. 6,997,859 issued Feb. 14, 2006 identified above, the subject matter of which is incorporated herein by reference.

Each of the ribs 20 is defined by the side walls of the adjacent recesses which converge toward an inner most wall 48 of the rib which extends in a direction parallel to the axis 15. Thus the inner wall 48 of the ribs lie on a frusta conical surface parallel to and spaced inwardly from the surface defined by the bars 34.

Figure 5:
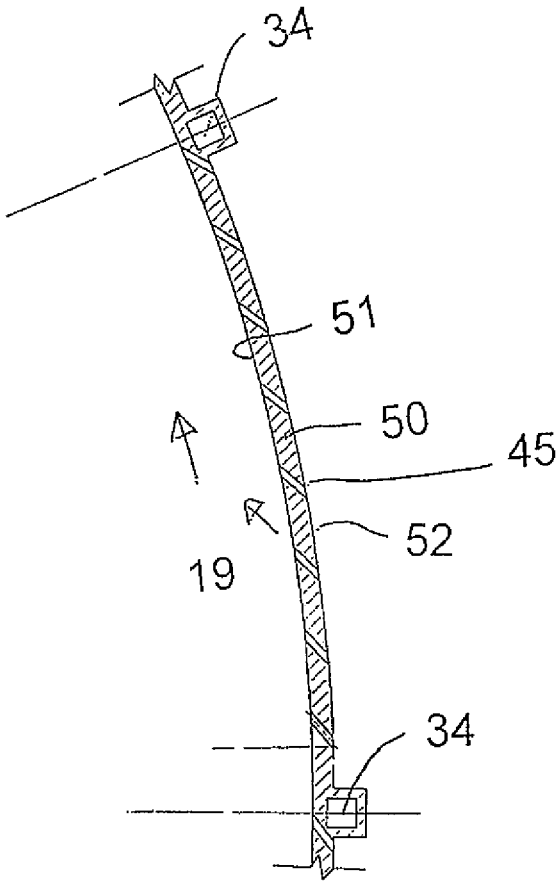
FIG. 5 is a cross sectional view on an enlarged scale taken along the lines 5-5 of the bowl of FIG. 1.

As best shown in FIG. 5, in the area at the base of the recesses is provided a wall portion 50 defined by the molded material of the liner which is unsupported by the rings above and below the recess and is unsupported by the bars 34 spaced angularly around the bowl. This therefore provides generally a rectangular area of the liner material which is completely unsupported by metal structure. This portion of the liner is of course integral with the components which are supported by the rings and the bars so that it is integral with the ribs 20. The inside surface 51 of this wall portion 50 therefore defines the surface at the base of the recess. The outside surface 52 of this wall portion faces into the chamber 21A which is filled with the fluidization water for injection through the drilled or formed openings 45 and 46.

In FIG. 3 there are shown the two rows of the openings which are spaced axially along the bowl that is at the top and bottom of the base 44 respectively. However a single row of such openings or more than two rows may be provided. As shown in FIG. 5 the openings are formed through the wall so that they are not at right angles to the wall but instead extend at angle so as to inject the fluidizing water into the recess 19 in a direction which tends to cause the fluid in the recess to move angularly around the bowl. Typically this direction of injection is opposite to the direction of rotation of the bowl but it can be in the other direction also.

In the area of the rib 20, the liner material is cast onto the respective ring 31 so that the ring is located centrally within the rib with the walls 41 and 42 extending inwardly toward the axis 15 from the inner surface 39 of the ring. Thus the rib forms a cantilevered portion of the liner material alone which extends inwardly beyond that inner surface 39.

The structure of the metal skeleton and also the thickness of the liner material at the ribs 42 is generally sufficient to maintain these components in fixed position without any significant flexing of the structure during the operation. However the wall portions 50 between the rings and between the bars are of a thickness to allow some flexing of the wall portion without significantly changing the structure or the shape of the recess.

Typically the thickness of the wall portion 50 can lie in the range 3/16 to 3/8 inch. In a situation where the space between the rings 31, 32 33 etc is of the order of 1.25 to 1.75 inch and the space between the bars 34 is between the order of 8 to 10 inches, this allows a slight flexing of the wall portion 50 inwardly and outwardly under the conditions described above with that flexing movement being of the order of 0.005 to 0.080 inch. As explained previously, this flexing action is sufficient to cause any scale forming on the surfaces of this portion to be cracked and discarded to prevent the scale from building to any significant thickness. As the cycling of the bowl is repeated periodically during the batch processing system, this flexing action occurs on a number of occasions during each cycle so that any collecting scale tends to break away from the surfaces and is discarded. At the same time the flexing of the wall portion 50 can also release from the openings 45 or 46 any particles which have become trapped between the components of the flexible layer with the slight flexing action being sufficient to release such components so that they can be injected back into the bowl or released outside the bowl depending on their location within the respective opening.

Typically scale can form on the outside surface 52 which eventually interferes with the proper injection of the fluidizing water through the openings 45 and 46. The flexing action together with the fact that the scale forms directly on urethane layer rather than a metal layer allows a better release from the scale surface 52 as compared to conventional metal bowls of this general nature.

Turning now to FIGS. 1, 2, 3 and 6, it will be noted that the bowl 10 is formed in a number of separate components which can be assembled together to form a bowl structure. This assembly of independent components which are clamped together using the external jacket 22 as the main clamping component allows simple disassembly of the bowl 10 to replace worn components of the bowl while other components remain for further use after reassembly. Thus the bowl itself comprises an upper ring 55, a peripheral wall component 56, a bowl base portion 57 a base wear liner portion 58 and a deflector pad 11A.

Figure 2:
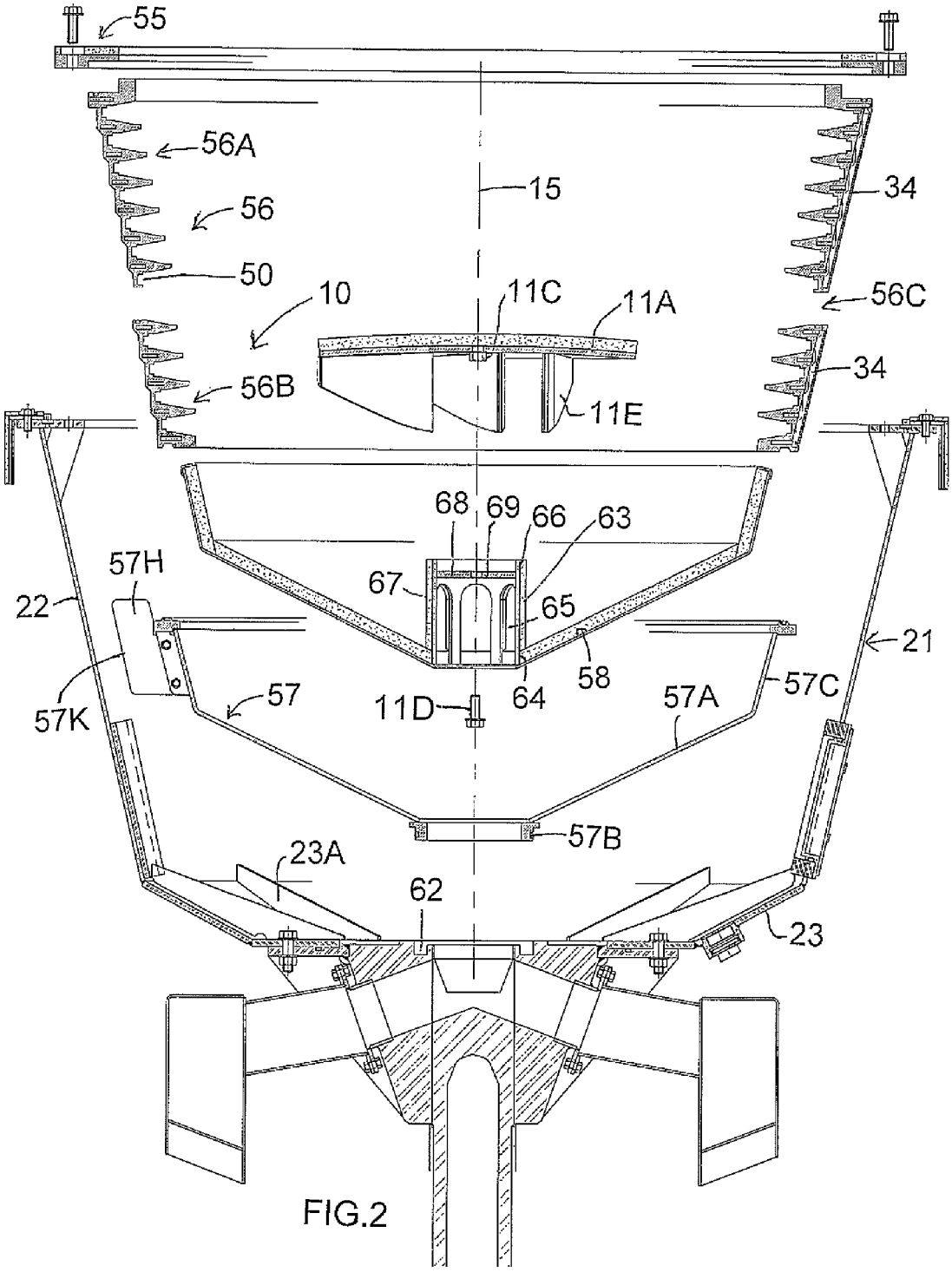
FIG. 2 is an exploded view of the bowl of FIG. 1.

The peripheral wall portion 56 as shown in FIG. 1 is formed as a single element extending from the lower end 35 to the upper end 36. In FIG. 2 the peripheral wall component 56 is divided into two sections 56A and 56B separated at a junction 56C so that the two components can be replaced independently. It is known that wear occurs at a higher level at the lower end of the bowl than at the higher end of the bowl so that forming the lower portion of the bowl from a separate section 56B allows this to be replaced more frequently while the upper section remains for use with reassembly with a new lower portion.

Each of the portions 56A and 56B of the peripheral wall is formed in the same skeleton and molded liner construction as previously described. The lowermost wall portion 50 is molded onto one or other of the molded sections 56A or 56B so that when the sections are connected together there is formed an integral structure where the wall portion 50 engages and co-operates with the next adjacent rib of the lower section 56B.

The interconnection between the upper section 56A and the ring 55 is best shown in FIG. 3. In this arrangement the ring 55 is formed of a base section constructed of metal as indicated at 55A onto the top of which is molded a wear liner portion 55B. The ring 55 is clamped onto a top of the outer shell 21 and particularly to a top ring of that shell. The top ring 21B is arranged at right angles to the top of the shell 21 and is welded thereto as indicated at 21C. The ring 21B extends inwardly to an inner end 21D. A fastener 60 extends through a hole 55C in the ring 55 and engages into a threaded hole 21E in the top ring 21B of the shell. A series of braces are provided as indicated at 21F at spaced positions around the shell 21 so as to support the ring 21B in the required horizontal orientation. The ring 21B also carries a guide flange 21G which is covered by a liner 21H so as to guide the material escaping from the open mouth 13 of the bowl over the ring 55 and over the ring 21B into the launder as previously described.

The upper most rib 31C is shaped differently from the remaining ribs and is shaped to cooperate with the clamping ring 55. Thus the rib 31C extends inwardly to a surface 31D which defines an annular surface forming the open mouth. A top surface 31E is arranged to coincide with the top surface of the ring 55. A recess section 31F receives the ring 55 so that it is recessed behind the top surface 31E. The inner edge 21D of the ring 21B of the shell is arranged to butt and locate the outside annular surface 31J of the ring 31B. Thus the ring 21B acts to locate the top ring 31B of the bowl itself so as to accurately locate at required radius from the axis the top of the bowl to hold that in position. The ring 55 clamps down onto a top surface 31K of the ring 31B so as to press the peripheral wall portion of the bowl downwardly to clamp this onto the bottom section 57 of the bowl.

Figure 6:
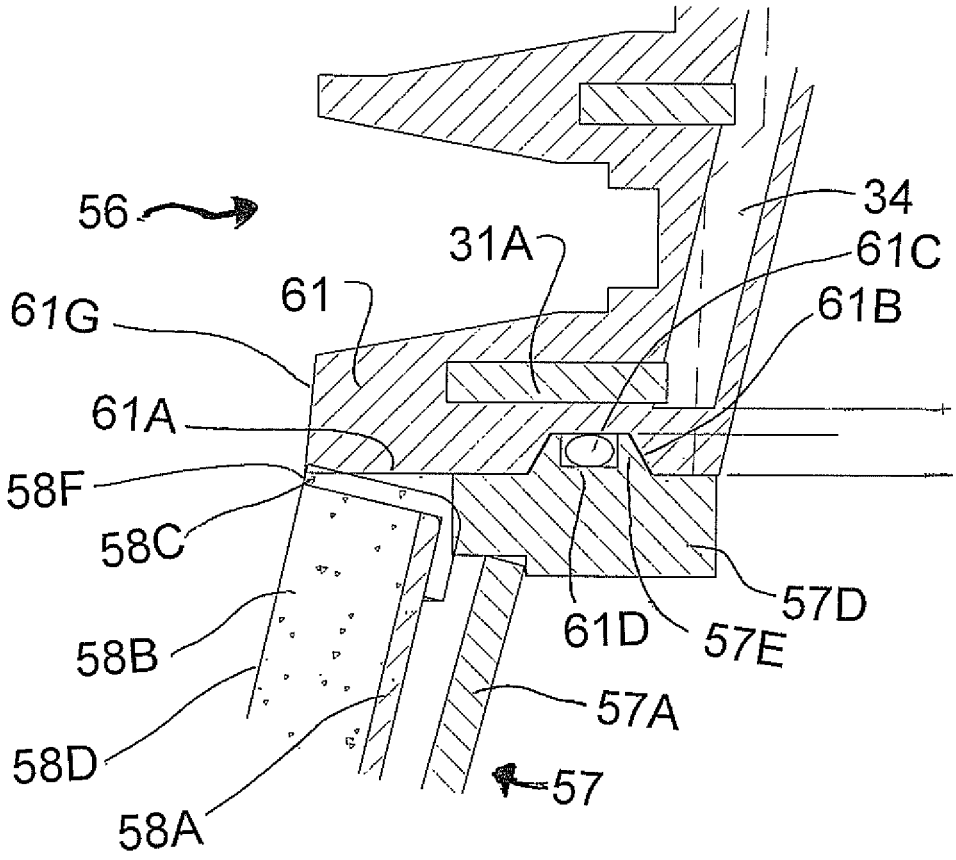
FIG. 6 is a cross sectional view on an enlarged scale of the detail D of the bowl of FIG. 1.
Figure 7:
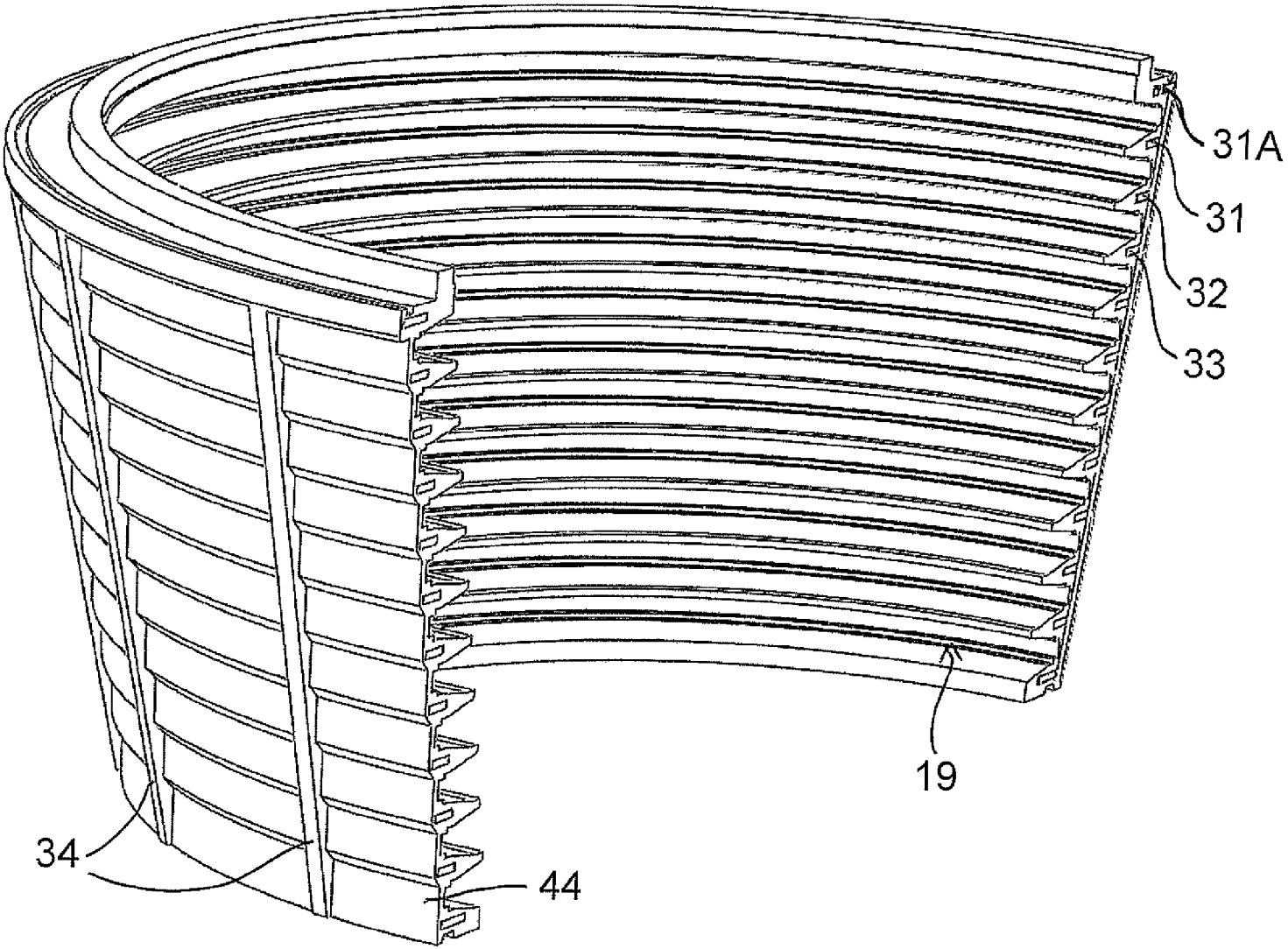
FIG. 7 is an isometric view partly broken away of the peripheral wall portion of the bowl of FIG. 1.

The interconnection between the upper edge of the bottom bowl portion 57 and the bottom of the peripheral wall portion 56 is shown in FIG. 6. Thus the bottom bowl portion 57 is formed of a first frusto conical section 57A which extends outwardly from a circular bottom ring 57B upwardly and outwardly to a second frusto conical section 57C which extends upwardly at an angle to the first portion 57A. At the top of the portion 57A is provided a mounting flange 57D. This mounting flange is welded to the top edge of the metal portion 57A and extends outwardly therefrom to support the bottom end of the peripheral wall portion 56. The bottom end of the portion 56 is defined by the bottom ring 31A and the rib portion 61 cast onto that bottom ring 31A. The rib portion 61 provides a bottom surface 61A which forms the bottom of the cast bowl section. This bottom surface 61A is recessed as indicated at 61B in a tapered recess for receiving a correspondingly tapered rejection 57E provided on the flange 57D. The tapered projection extends around the flange 57D as an annular projection and converges upwardly and inwardly so as to extend into the corresponding shape recess 61B molded into the bottom of the molded section of the peripheral wall portion 56 of the bowl. An O-ring 61C is received in a channel 61D formed centrally along the annular projection 57E. The O-ring therefore co-operates between the flange and the bottom of the bowl to provide a seal at this location.

The bowl further includes the wear liner section 58 which is formed as a metal shell 58A and the inner liner 58B which may be cast in place or may form simply a liner material. These simply sit in the metal outer support portion 57 and this wear liner is therefore clamped into place against the upper surface of the portion 57 and with an uppermost edge 58C butting against the bottom surface 61A of the bottom ring 31A.

The inner wear bowl section 58 thus provides an innermost surface 58D which is generally frusta conical and diverges outwardly from a bottom end 58E to a top end 58F. This surface 58D forms a primary wear surface section where the feed moving outwardly from the bottom plate 11A first engages the bowl and is accelerated to bowl speed. This relatively short section of the bowl therefore receives the feed and acts to accelerate the feed on a smooth frusto conical surface section before the feed materials reach the surface 61G of the first rib 61 of the bottom ring 31A. Thus the materials flow from the surface 58D onto the surface 61G without any water fall effect and flow smoothly over those surfaces to enter onto the peripheral wall where the separation takes place within the fluidized recesses 19.

The bottom ring 57B of the bottom bowl portion 57 fits into a recess 62 at the base of the outer shell 21. The outer shell therefore provides the structural support for the inner bowl so that the clamping action of the ring 55 presses downwardly through the peripheral wall portion 56 and the bottom bowl portion 57 onto the base 23 of the outer shell 21. The base 23 carries a plurality of outwardly extending ribs 23A which provides reinforcement for the outer shell. The bottom bowl section is carried in fixed position located directly around the axis 15 and centered by the recess 62 and by a centering action provided by a plurality of wings 57H on the outside of the bottom bowl portion 57. These wings 57H are located at spaced positions angularly around the bottom bowl portion and are arranged with an outer edge 57K for engaging the inside surface of the wall 22 of the outer shell. Thus the wings are attached to the wall portion 57C act to accurately center this wall portion 57C within the outer shell. In this way the bottom bowl section is properly centered and this carries and locates the peripheral wall portion 56 as previously described so that these elements are also properly centered around the axis 15. The wear bowl section 58 is a readily replaceable wear section which can be removed when required. It is located and centered by its engagement with the inside surface of the bottom bowl portion 57.

The bowl section 58 further includes a central pedestal 63 which stands upwardly from the bottom of the bowl section 58 at a circular bottom opening 64. The pedestal thus forms a cylinder surrounding this opening 64 and as a plurality of discharge openings 65 through which the collected materials can be discharged during the discharge cycle previously described. The pedestal thus includes an annular sleeve 66 carrying a wear layer 67 surrounding the sleeve. A top plate 68 of the pedestal is located inside the sleeve 66 and provides a central mounting hole 69 onto which the bottom plate 11A is mounted by a fastener 11D extending through the hole 69 and engaging a nut 110 on the bottom of the plate 11A. Thus the conventional bottom plate 11A is mounted onto the pedestal by a single central fastener 11D. The bottom plate 11A is supported by radially extending wings 11E which extend downwardly from a bottom surface of the plate and engage the upper surface of the wear bowl section 58 so as to properly locate and support the plate 11A which is clamped downwardly onto these surfaces by the single fastener 11D.

Figure 8:
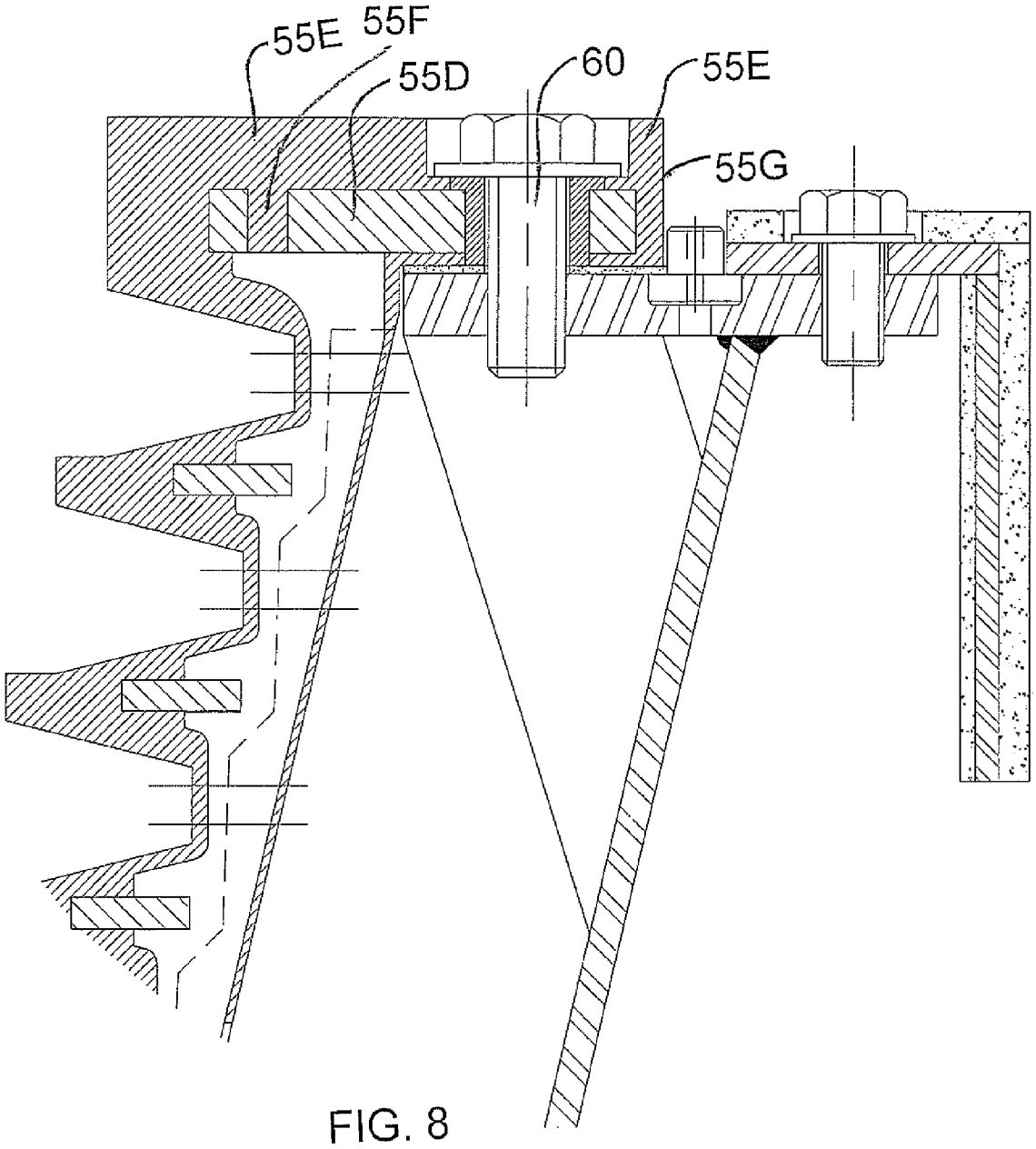
FIG. 8 is a cross sectional view similar to that of FIG. 3 which shows an alternative construction of the top portion of the bowl and its connection to the ring of the shell.

Turning now to FIG. 8, this shows an alternative construction of the top portion of the bowl and its connection to the ring 21B of the shell 21. Thus instead of the arrangement shown in FIG. 3, the separate fastening ring 55A and the top ring 31B of FIG. 3 are formed as an integral component 55D which is a single ring embedded in and integral with the frame of the bowl. Thus the integral top ring 55D is connected to the support bars which interconnect the rings 31, 32, 33 etc. This makes the structure potentially more stable in that the top fastening ring 55D is now integral with the bowl rather than acting to merely clamp a top edge of the bowl downwardly. Also the covering wear ring 55B of FIG. 3 is replaced by an integral portion 55E of the liner of the bowl which extends over the top ring 55D. The integral portion 55E extends outwardly past the bolts 60 to an outer edge 55G outwardly of and containing the outer edge of the top ring 55D. A series of holes 55F is provided around the ring 55D at positions close to the inner edge of the ring so that the molded liner material enters the holes to provide an improved connection to the ring 55D.

Figure 9:
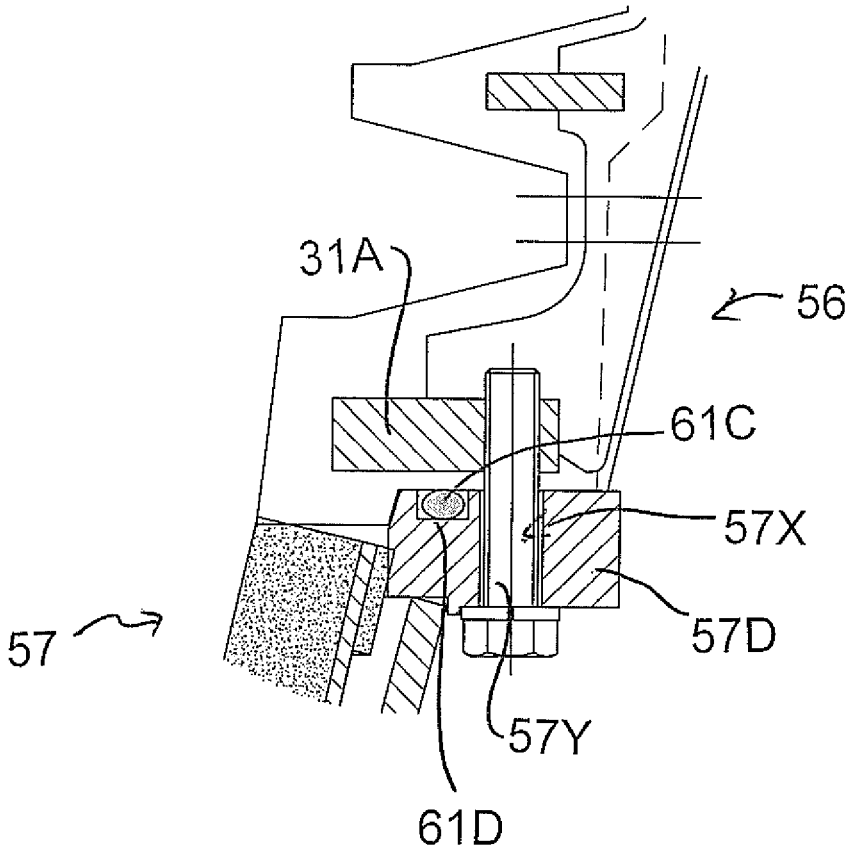
FIG. 9 is a cross sectional view similar to that of FIG. 6 which shows an alternative construction of the bottom bowl portion and its connection to the peripheral wall.

Turning now to FIG. 9, this shows an alternative construction of the connection between the peripheral wall portion 56 and the bottom bowl portion 57. Thus instead of the arrangement shown in FIG. 6, there is provided a bolted connection 57X between the top flange 57D of the bottom bowl portion and the bottom ring 31A of the peripheral wall. The bolted connection is provided by a series of bolts 57Y at spaced positions around the bowl with each bolt acting to clamp the ring 31A to the flange 57D while squeezing a portion of the liner material between these components. The O-ring 61C is located in a recess 61D in a top surface of the flange 57D and butts against the bottom of the liner portion of the peripheral wall 56. This connection avoids a potential safety concern related to lifting the bowl out of the machine. With scale build-up on the outer surface of the bowl there is the potential for the bottom bowl portion to stick to the peripheral wall and the chance that the bottom bowl portion could simply fall off the bottom of the peripheral wall during removal. The bolted connection also provides additional stability and pressure resistance in this area.

With this connection the peripheral wall and bottom bowl portion along with the wear cone and deflector pad are pre-assembled outside of the machine and lowered into the outer shell. In this arrangement the wings 57H on the bottom bowl portion can be omitted since the bolted connection 57X provide the necessary centering action.

The arrangement described herein therefore may provide one or more of the following improved features:

1. The holes are located in a flexible wall providing self-cleaning of the fluidization water holes during each concentrate flush cycle. Thus there is no steel shell supporting the liner at the holes so the urethane wall section where the fluidization holes are drilled flexes at a different rate than the thicker sections formed by the urethane ribs (rings), which also have internal steel rings to provide structure. This flexing during each flush cycle may promote the breaking-up of any scale that forms on the surfaces of the bowl including the inside surface or more particularly the outside surface where the scaling problem is more acute. In addition the flexing also may act in helping to dislodge particulates that may be blocking the fluidization holes. The typical cycle that the bowl sees that will flex the bowl wall consists of:

Static condition (no pressure against bowl wall in either direction);

Fluidization water pressure applies fluid pressure against the bowl wall causing flexing towards the center;

The Rotor is brought up to speed so that G-force reduces the effect of the fluidization water pressure on the outside of bowl, flexing the wall back towards the neutral position;

The Feed is turned on for a concentrating cycle so that the feed in the rings under G-forces flexes the wall towards or past the neutral position;

The Flush cycle begins: the Feed turned off, fluidization water flow reduced and rotor ramped to stop which causes only minor changes to the wall position during these transitions.

Concentrate flush: the Rotor is stopped and fluidization water flow increased of the order of 15-20% above the concentrating flow set point to cause high flow to flush concentrates from the rings and the resultant pressure from outside combined with no G-force flexes the wall inwards to the furthest degree in the cycle;

Concentrate drain time: the Rotor still stopped and fluidization water shut off so there is no pressure and the wall returns to the static condition;

The Cycle is repeated.

Thus the varying conditions may provide numerous cycling positions of wall flex, which may act to break up any scale that forms. Thus the flexing action stops the collection of scale from reaching thick layers that currently form on the conventional stainless steel bowl shell and can eventually bridge over the fluidization holes.

This scaling problem happens at many installations and forces the user of the machine to remove and clean the bowl.

2. The use of a urethane ribbed bowl section with internal structural skeleton to replace the conventional stainless steel bowl structure may act to reduce scale build-up since the use of urethane allows the build up of scale at a reduced rate relative to steel or stainless steel, even without the wall flexing.

3. The use of a modular design which allows replacement of the bowl in two or more pieces. That is the bowl is formed from a number of interconnected sections including a base section defining a bottom and part of the peripheral wall and a wall section including the recesses. A top clamping ring section may be separate from the peripheral wall or maybe formed integrally therewith. The wall section can be manufactured as a single part which has a one-piece ribbed section. Alternatively, the wall section can be further split into two or three pieces which can be stacked or assembled one on top of the next.

4. The drilling of the fluidization holes through the flexible urethane membrane rather than through the steel wall may be advantageous.

5. A "pedestal" style wear bowl and simplified deflector pad at the base of the bowl with a single fastener can provide a simpler and more effective construction. The urethane liner can be used to hold the wear bowl/deflector pad assembly in place.

6. The three angularly spaced bolt-on wings added to the lower bowl section can be used to center the base portion in the outer housing and may help ensure the urethane liner is installed concentric with the lower bowl.

7. A protected O-ring sealing surface on the bottom of the urethane liner may be recessed to protect this surface from contamination and damage when it is being handled or stored outside the machine. Recessing the O-ring sealing surface also benefits the urethane casting process by helping ensure air bubbles do not accumulate in this area. The urethane liner can be cast upside down so air bubbles accumulate on the top surface during casting which is the bottom surface when installed in the machine.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

The invention claimed is:

1. A centrifuge bowl for use in an apparatus for separating intermixed particulate materials of different specific gravity in a slurry where the apparatus includes a feed duct for feeding the slurry into the bowl during rotation of the bowl so that during rotation of the bowl the intermixed particulate materials flow over a peripheral wall of the bowl for collection of heavier particulate materials on the peripheral wall and for discharge of the lighter particulate materials in the slurry from the open mouth, the bowl comprising:

a peripheral wall surrounding an axis with the wall generally upstanding from a lower end to an open mouth;

wherein the peripheral wall includes a supporting frame formed of a rigid material and a flexible liner material molded onto the supporting frame;

the supporting frame being defined by a plurality of ring members which are axially spaced each from the next to define a space between each ring member and the next;

the supporting frame including a plurality of generally axially extending support members;

wherein the axially spaced ring members are connected each to the next by the generally axially extending support members which are angularly spaced to define a space between each support member and the next;

the flexible liner material being molded onto the supporting frame to define an inner surface of the peripheral wall and to fill the spaces between the ring members and between the support members.

2. The bowl according to claim 1 wherein there is provided a fluidizing liquid injection system for fluidizing the materials on the peripheral wall including a liquid supply outside the wall and a plurality of liquid entry openings at angularly spaced positions around the wall.

3. The bowl according to claim 2 wherein the liquid entry openings are located in the flexible liner material at positions thereon separated from the supporting frame.

4. The bowl according to claim 3 wherein the flexible liner material is arranged to flex in response to changes in pressure in the fluidizing liquid.

5. The bowl according to claim 2 wherein the fluidizing liquid injection system includes a chamber outward of the peripheral wall in which the fluidizing liquid is located such that the fluidizing liquid contacts an outer surface of the flexible liner material to cause the liner material to flex.

6. The bowl according to claim 1 wherein the flexible liner material is urethane.

7. The bowl according to claim 1 wherein the inner surface of the peripheral wall includes a plurality of annular recesses on the peripheral wall at axially spaced positions over which the materials pass when fed from the supply duct.

8. The bowl according to claim 7 wherein each recess is defined by an upper recess side wall on the upper side and a lower recess side wall on a lower side with each of the side walls extending generally outwardly from the axis from an open mouth of the recess toward a base of the recess, the upper side wall of each recess being connected to the lower side wall of a next adjacent recess to form a rib between the recesses such that the bowl includes a plurality of recesses and a plurality of ribs arranged alternately along the peripheral wall.

9. The bowl according to claim 8 wherein the ring members form annular disks each lying in a radial plane of the axis of the bowl and each arranged in a respective one of the ribs.

10. The bowl according to claim 8 wherein the ribs and the recesses are molded in the liner material.

11. The bowl according to claim 1 wherein the peripheral wall is formed as a single member extending from a base section of the bowl to a top ring.

12. The bowl according to claim 1 wherein the peripheral wall is formed as a plurality of separable members stacked one above the next.

13. The bowl according to claim 1 wherein the bowl includes a base section which is separable from the peripheral wall and there is provided a clamping assembly arranged to hold the base section and peripheral wall in a stacked assembled position.

14. The bowl according to claim 13 wherein the clamping assembly comprises an exterior drum surrounding the peripheral wall within which the base section and the peripheral wall are mounted.

15. The bowl according to claim 14 wherein the base section includes a plurality of angularly spaced locating wing members for engaging the exterior drum to locate the base section in the drum.

16. The bowl according to claim 13 wherein the base section includes a central pedestal member standing upwardly from a bottom of the base section onto the top of which is mounted a deflector pad.

17. The bowl according to claim 16 wherein a single central fastener is used to attach the deflector pad to the pedestal member.

18. The bowl according to claim 13 wherein the base section comprises a generally concave portion with a generally upstanding surrounding wall and wherein the peripheral wall portion has a bottom edge which butts the top edge of the surrounding wall.

19. The bowl according to claim 13 wherein the peripheral wall includes a top clamping ring for engaging a top of the clamping assembly.

20. The bowl according to claim 19 wherein the top clamping ring is integral with the peripheral wall.

* * * * *